US010465372B2

(12) United States Patent
Bowles et al.

(10) Patent No.: US 10,465,372 B2
(45) Date of Patent: Nov. 5, 2019

(54) DRAIN CLEANING TOOLS

(71) Applicant: Ridge Tool Company, Elyria, OH (US)

(72) Inventors: Richard R. Bowles, Solon, OH (US); Brandon Moherman, Sheffield Village, OH (US); Prasad Chatursingh Patil, Pune (IN)

(73) Assignee: Ridge Tool Company, Elyria, OH (US)

( * ) Notice: Subject to any disclaimer, the term of this patent is extended or adjusted under 35 U.S.C. 154(b) by 304 days.

(21) Appl. No.: 15/442,764

(22) Filed: Feb. 27, 2017

(65) Prior Publication Data

US 2018/0142458 A1 May 24, 2018

(30) Foreign Application Priority Data

Nov. 24, 2016 (IN) ..... 201621040159

(51) Int. Cl.
*E03F 9/00* (2006.01)
*B08B 9/045* (2006.01)
*E03C 1/302* (2006.01)

(52) U.S. Cl.
CPC ..... *E03F 9/005* (2013.01); *B08B 9/045* (2013.01); *E03C 1/302* (2013.01)

(58) Field of Classification Search
CPC ..... E03F 9/005; B08B 9/045; E03C 1/302
USPC ..... 15/104.33
See application file for complete search history.

(56) References Cited

U.S. PATENT DOCUMENTS 2,600,707 A 6/1952 Turnbaugh
2,603,495 A 7/1952 Hermanson
4,218,802 A 8/1980 Babb et al.
4,763,374 A 8/1988 Kaye
4,793,017 A 12/1988 Kaye
4,956,889 A * 9/1990 Kirk ..... E03F 9/005 15/104.33
5,029,356 A * 7/1991 Silverman ..... E03F 9/005 15/104.33
5,173,984 A 12/1992 Kaye
5,265,301 A * 11/1993 Irwin ..... E03F 9/005 15/104.33
5,301,382 A * 4/1994 Stout ..... E03F 9/005 15/104.33
5,414,888 A * 5/1995 Irwin ..... E03F 9/005 15/104.33

(Continued)

FOREIGN PATENT DOCUMENTS

GB 2340422 2/2000

OTHER PUBLICATIONS

European Search Report dated Sep. 13, 2018; Application No. 17201903.6; 8 Pages.

*Primary Examiner* — Weilun Lo
(74) *Attorney, Agent, or Firm* — Rankin, Hill & Clark LLP; Mark E. Bandy

(57) ABSTRACT

Drain cleaning tools are described. The tools typically include a hollow drum for housing a drain cleaning cable, an elongated cable guide, a locking nut engageable with the cable guide for selectively engaging the cable, and a rotatable handle on the cable guide. A particular configuration is used at an open end of the cable guide to facilitate engagement, i.e., selective locking and unlocking, of the cable. One or more flexible members are provided in the cable guide for rotatably retaining the handle about the cable guide.

20 Claims, 10 Drawing Sheets

(56) References Cited

U.S. PATENT DOCUMENTS

| | | | | |
|---|---|---|---|---|
| 5,987,684 | A * | 11/1999 | Evans | E03F 9/005 15/104.31 |
| 6,009,588 | A | 1/2000 | Rutkowski | |
| 6,158,076 | A * | 12/2000 | Rutkowski | E03F 9/005 15/104.31 |
| 2012/0011906 | A1 | 1/2012 | Wildauer et al. | |
| 2013/0160227 | A1 * | 6/2013 | Rutkowski | B08B 9/0436 15/104.33 |
| 2014/0223679 | A1 * | 8/2014 | Silverman | E03F 9/005 15/104.09 |

* cited by examiner

DRAIN CLEANING TOOLS

FIELD

The present subject matter relates to drain cleaning tools. In particular, the present subject matter relates to low cost drain cleaning tools having a simplified assembly.

BACKGROUND

A wide variety of drain cleaning tools are known in the art. One type of tool is a drum-type drain cleaning tool which uses a rotatable drum in which a drain cleaning cable or "snake" is stored. Upon rotation of the drum, the cable is dispensed from, or retracted into, the drum. Such tools are known in manually driven forms or in powered versions.

Manually driven drum-type drain cleaning tools include a relatively large number of components which increase complexity and assembly costs. In addition, many of the components are metal and thus lead to a potential for scratching or otherwise damaging furnishings such as bathroom fixtures during use of the drain cleaning tool. Although many drain cleaning tools are satisfactory in various respects, a need remains for an improved tool which addresses the noted concerns.

SUMMARY

The difficulties and drawbacks associated with previous approaches are addressed in the present subject matter as follows.

In one aspect, the present subject matter provides a drain cleaning tool comprising a drum defining an interior hollow chamber for housing a drain cleaning cable. The drum defines a forward face and an oppositely directed rearward face. The drum includes a forwardly projecting hollow elongated cable guide. The cable guide defines a distal end opposite the rearward face and includes at least one flexible retaining member disposed between the distal end and the forward face of the drum. The drain cleaning tool also comprises a handle having an axially extending interior passageway sized to receive the cable guide. The handle is disposed about the elongated cable guide and is rotatable with respect to the drum. The handle defines an annular race within the interior passageway and the at least one flexible retaining member contacts the race, thereby rotatably retaining the handle about the cable guide of the drum.

In another aspect, the present subject matter provides a drain cleaning tool comprising a front drum defining a front face, a rearwardly extending cylindrical wall and a forwardly projecting hollow elongated cable guide. The cable guide defines a distal end opposite the cylindrical wall and includes at least one flexible retaining member disposed between the distal end and the front face of the drum. The distal end of the elongated cable guide includes (i) a plurality of axially extending flexible tabs integrally formed with the elongated cable guide and (ii) an outer threaded region. The tool also comprises a rear drum sized and shaped to engage a rearward face of the cylindrical wall of the front drum, and thereby form a chamber for housing a drain cleaning cable. The tool also comprises a nut defining (i) a rear face, (ii) a forwardly extending inner tapered face, and (iii) an inner threaded region configured to threadedly engage the outer threaded region of the cable guide.

In yet another aspect, the present subject matter provides a drain cleaning tool consisting essentially of a front drum including a front face, a rearwardly extending cylindrical wall, and a forwardly projecting hollow elongated cable guide. The cable guide includes (i) a distal end opposite the cylindrical wall, (ii) an arcuate wall extending between the distal end and the front face of the front drum, (iii) at least one flexible retaining member formed within the arcuate wall of the cable guide, (iv) a plurality of axially extending flexible tabs integrally formed with the cable guide and disposed at the distal end of the cable guide, and (v) an outer threaded region disposed between the plurality of axially extending flexible tabs and the at least one flexible retaining member. The tool also consists essentially of a rear drum including a rear face and a cylindrical wall. The rear drum is engaged with a rearward face of the cylindrical wall of the front drum, thereby forming a chamber for housing a drain cleaning cable. The tool also consists essentially of fastening provisions for securing engagement of the rear drum with the front drum. The tool also consists essentially of a knob engaged along the rear face of the rear drum. The tool also consists essentially of a handle having an axially extending interior passageway defining an annular race and rotatably disposed about the elongated cable guide of the front drum. The handle is disposed between the threaded region of the elongated cable guide and the front face of the front drum. The at least one flexible retaining member contacts the race and thereby rotatably retains the handle disposed about the cable guide. The tool also consists essentially of a flexible drain cleaning cable at least partially housed in the chamber formed from the front drum and the rear drum. The tool further consists essentially of a nut defining (i) a rear face, (ii) a forwardly extending inner tapered face; and (iii) an inner threaded region configured to threadedly engage the outer threaded region of the cable guide. The nut is threadedly engaged with the threaded region of the cable guide. At least a portion of the drain cleaning cable extends through the elongated cable guide and the nut, and upon rotation of the nut relative to the cable guide, the nut is linearly displaced against the plurality of axially extending tabs of the cable guide thereby resulting in deflection of the tabs against the drain cleaning cable to thereby secure the cable at a desired axial position relative to the cable guide.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

The present subject matter provides drain cleaning tools which are formed from a remarkably few number of components thereby reducing cost, complexity, and assembly demands. The drain cleaning tools also utilize a relatively high proportion of non-metallic components, thereby further reducing costs and avoiding the potential for scratching or otherwise damaging furnishings during use of the tool. In certain embodiments, the tools utilize a unique locking assembly for securing the drain cleaning cable in a desired position. And, in certain embodiments, the tools use a particular retaining assembly for rotatably securing a handle to the tool. Additional features and aspects are described herein.

Figure 1:
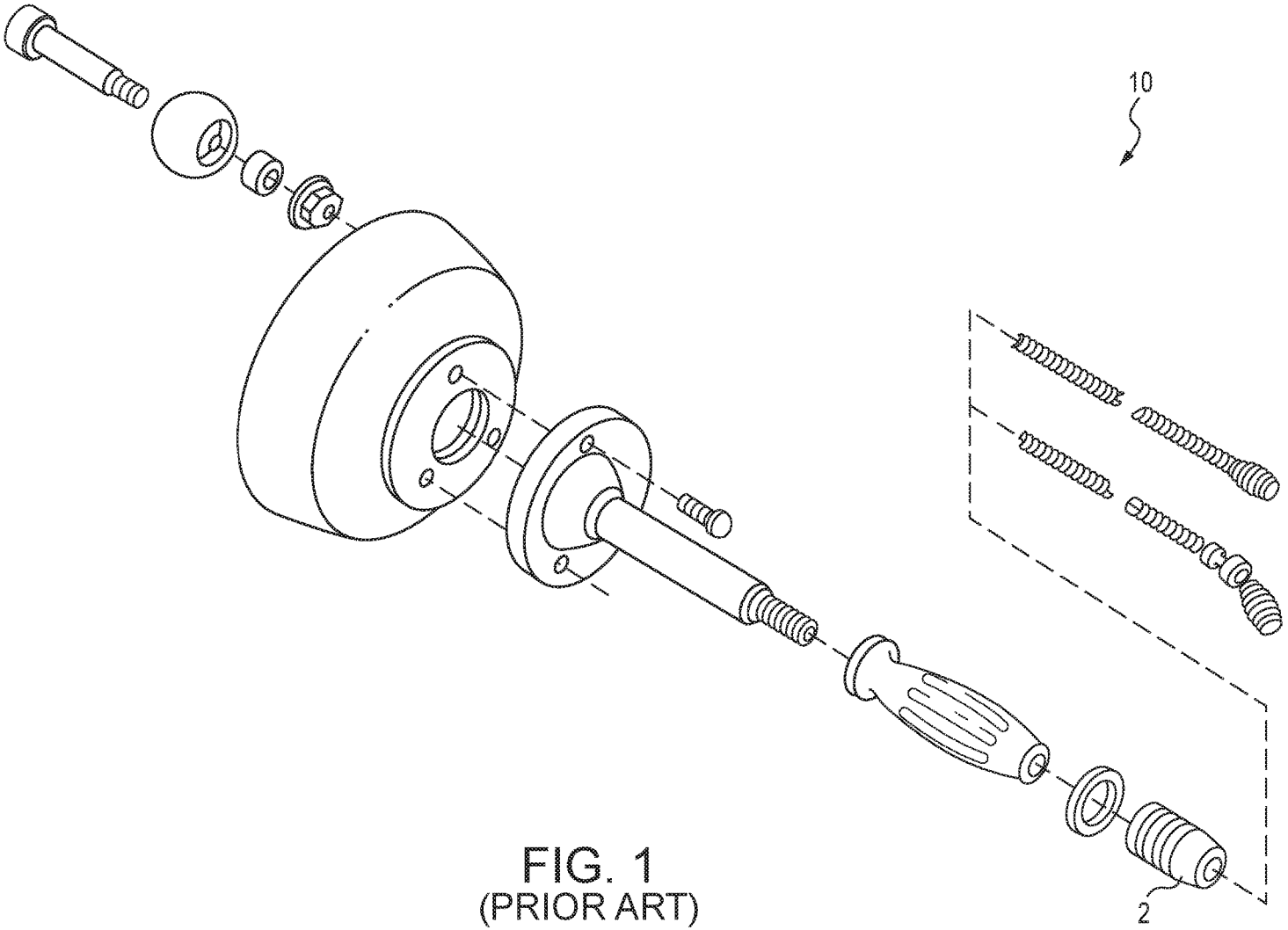
FIG. 1 (PRIOR ART)
FIG. 1 is an exploded assembly view of a prior art drain cleaning tool.
Figure 2:
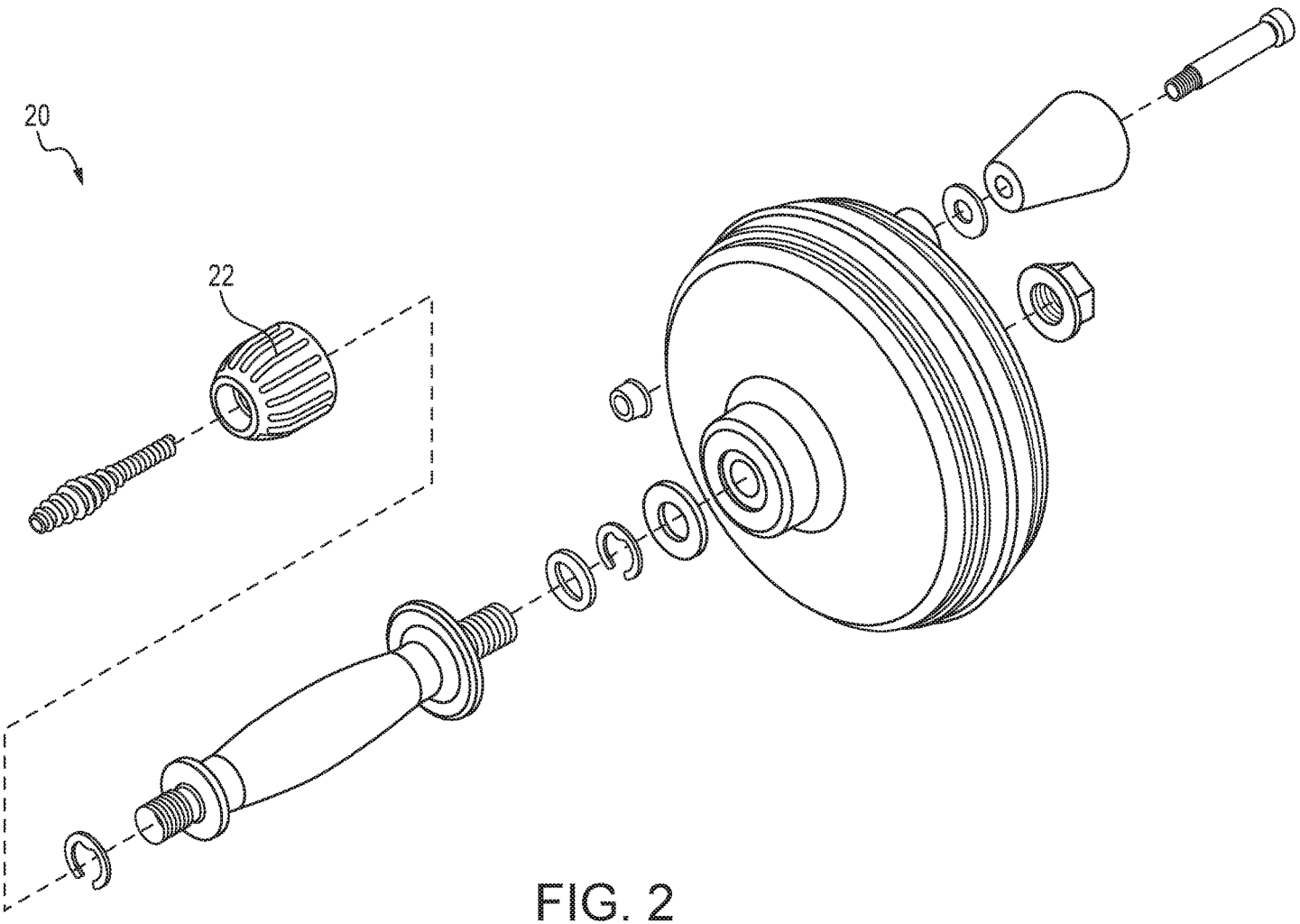
FIG. 2 (PRIOR ART)
FIG. 2 is an exploded assembly view of another prior art drain cleaning tool.
Figure 3:
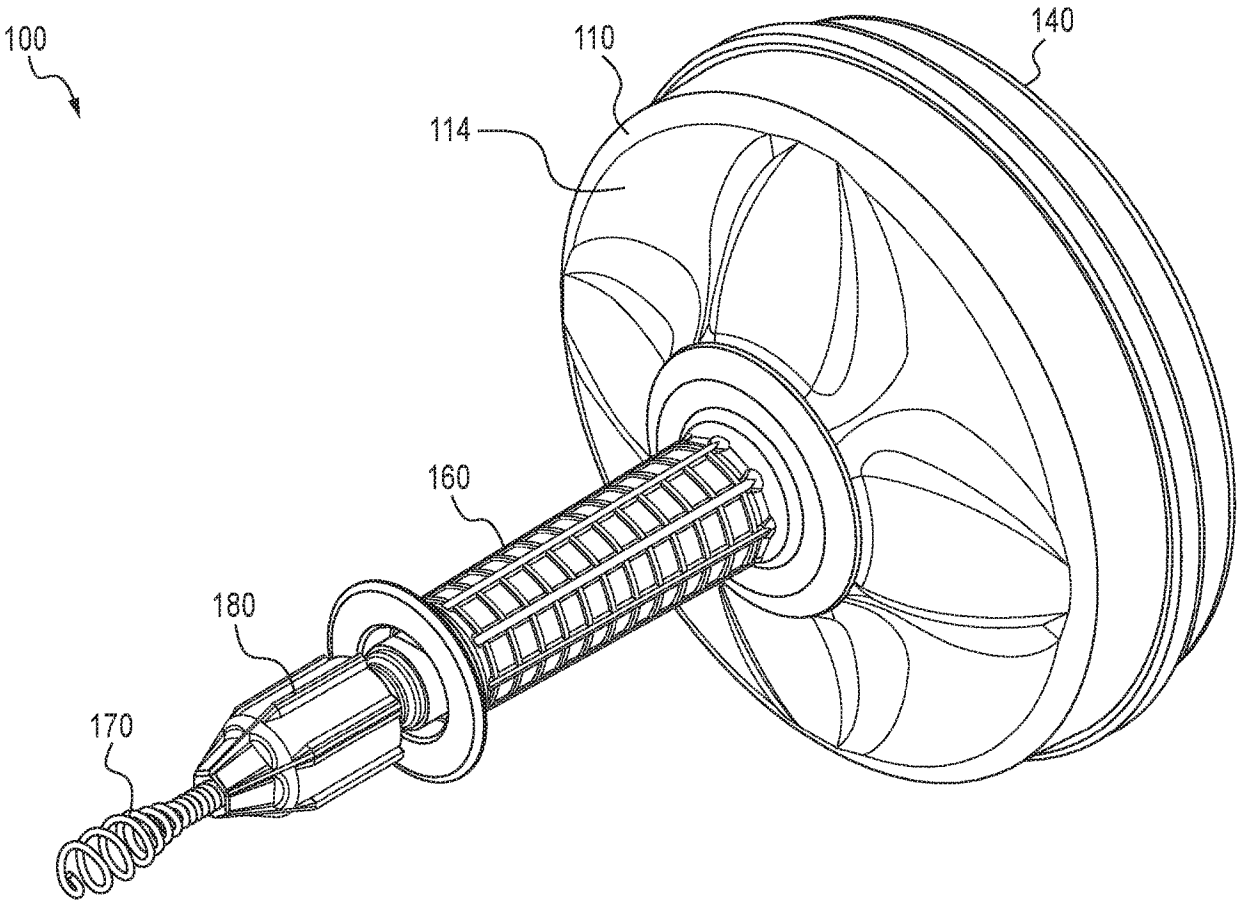
FIG. 3 is a front perspective view of an embodiment of a drain cleaning tool in accordance with the present subject matter.
Figure 4:
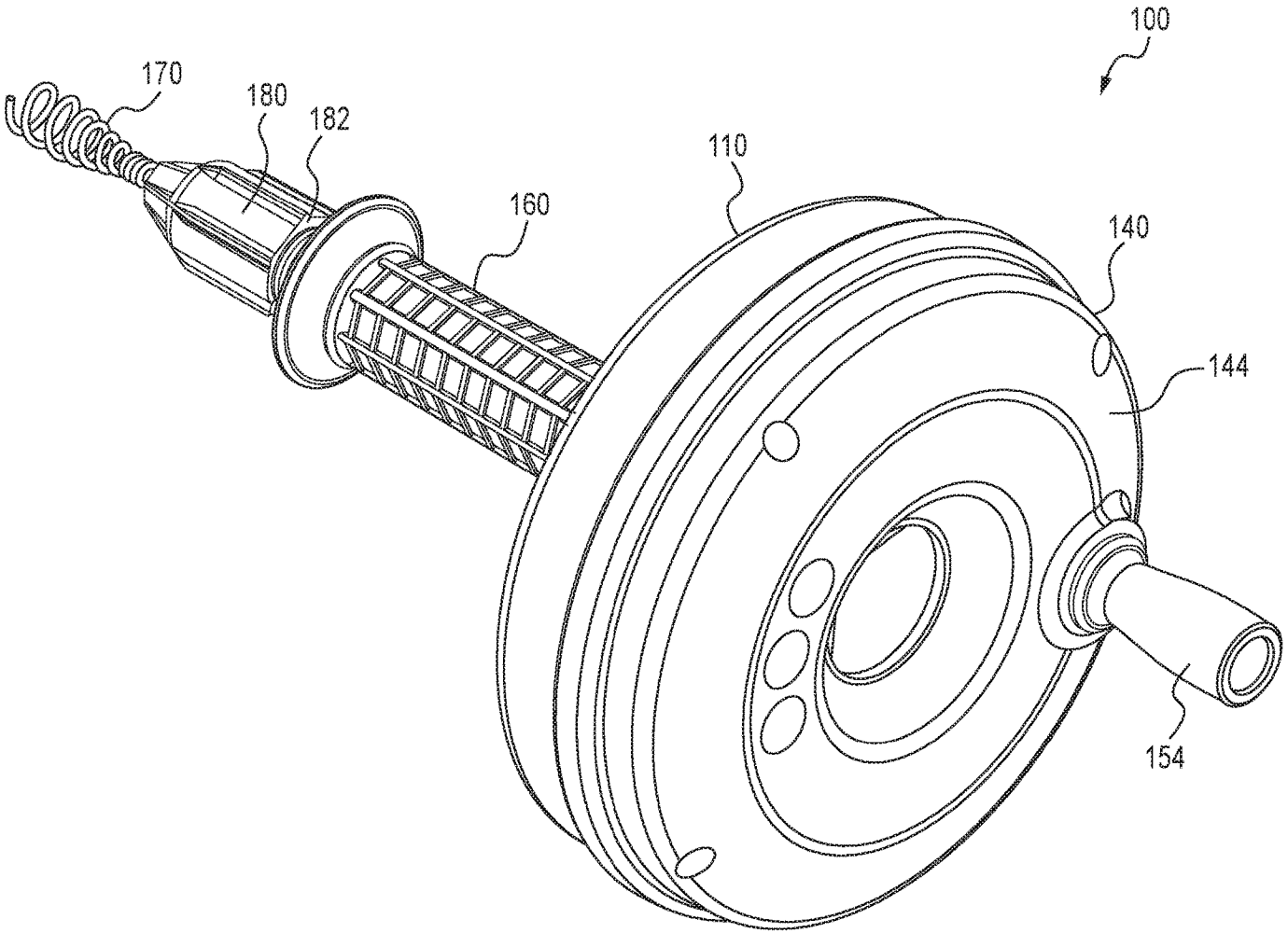
FIG. 4 is a rear perspective of the drain cleaning tool depicted in FIG. 3.

FIGS. 1 and 2 are exploded assembly views of two popular manually driven, drum-type drain cleaning tools known in the prior art. FIG. 1 illustrates a drain cleaning tool 10 commercially available from Ridge Tool Co. under the designation RIDGID Model K-25. FIG. 2 illustrates another tool 20 also commercially available from Ridge Tool Co. under the designation RIDGID Model K-26. Excluding the drain cleaning cable, the K-25 is assembled from ten (10) different components and the K-26 is assembled from a total of twelve (12) major components. Many of these components are metal such as the chucks 2 and 22 shown in the referenced figures which consist of 3 to 10 additional components in the subassemblies.

FIGS. 3-12 illustrate an embodiment of a drain cleaning tool 100 in accordance with the present subject matter. Generally, the drain cleaning tool 100 comprises a drum 110, 140 defining an interior hollow chamber 148 for housing a drain cleaning cable 170. The drum defines a forward or front face 114 and an oppositely directed rearward face 144. The drum includes a forwardly projecting hollow elongated cable guide 120. In many embodiments, the cable guide 120 is integrally formed with the drum 110 and more particularly with the front face 114 of the drum. The cable guide 120 defines a distal end 122 opposite the rearward face 144 of the drum and includes at least one flexible retaining member 126 disposed between the distal end 122 and the forward face 114 of the drum.

Figure 5:
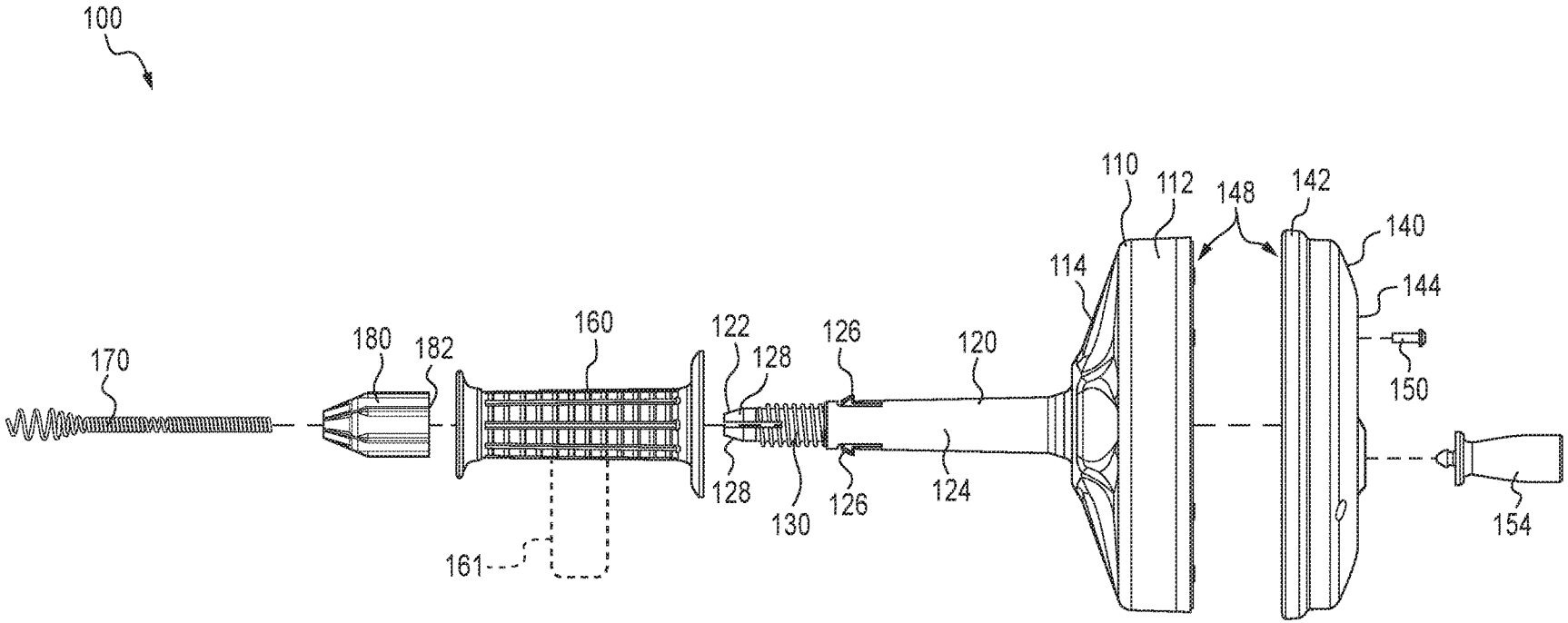
FIG. 5 is an exploded assembly view of the drain cleaning tool illustrated in FIGS. 3-4.
Figure 6:
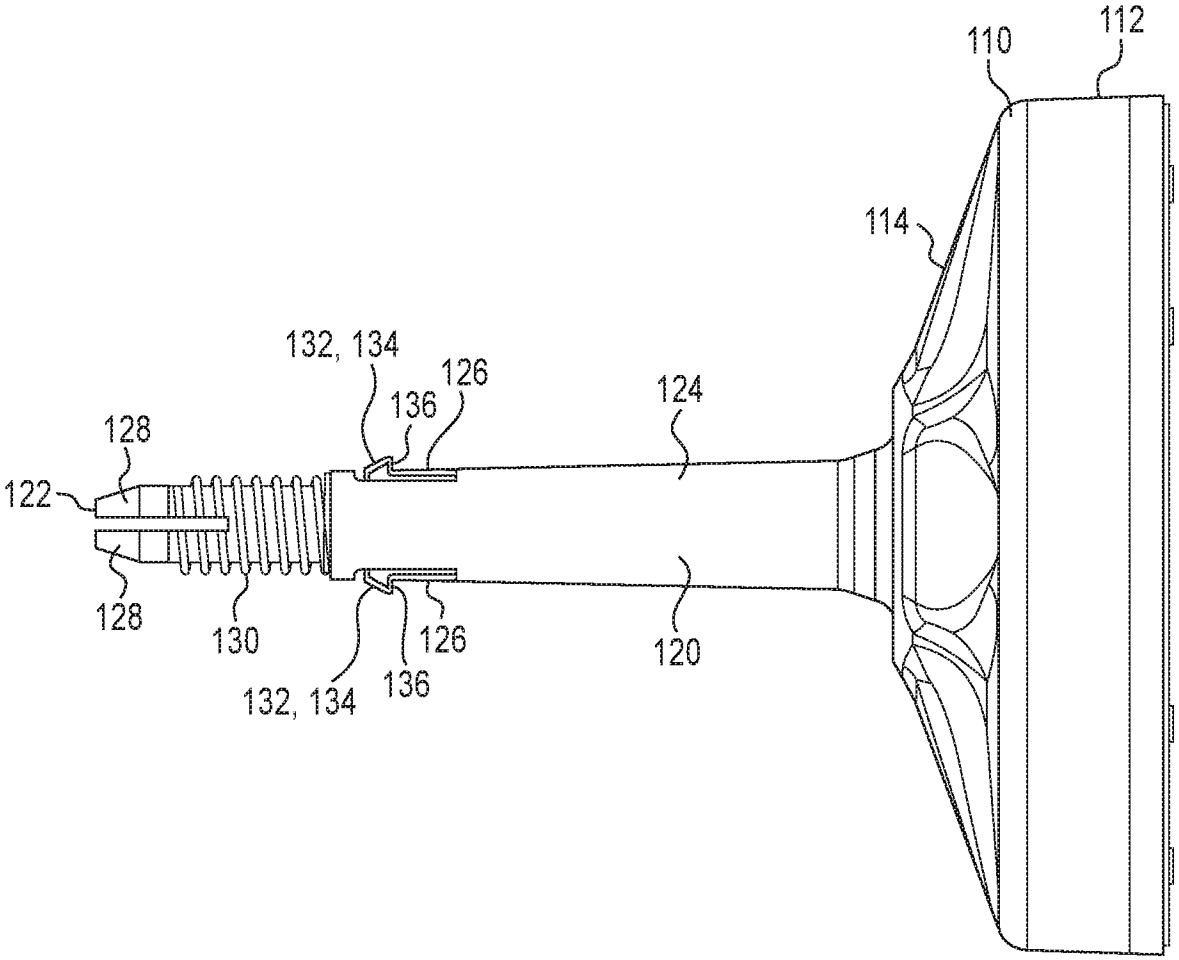
FIG. 6 is a side elevational view of a drum component of the tool shown in FIGS. 3-4.
Figure 8:
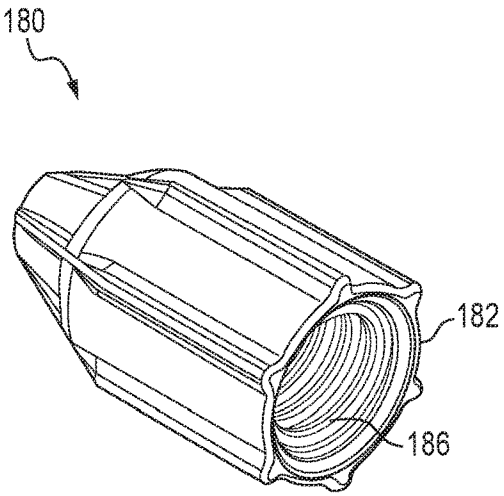
FIG. 8 is a rear perspective view of a nut component of the tool illustrated in FIGS. 3-4.
Figure 7:
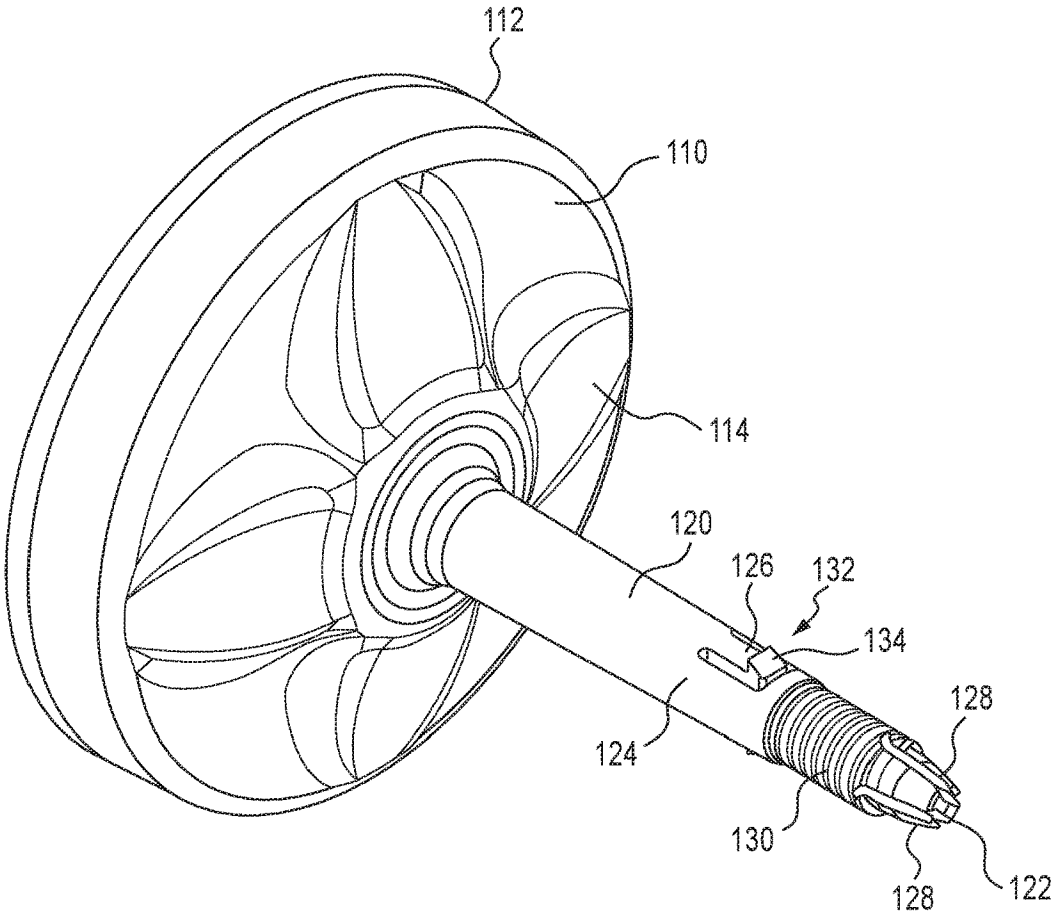
FIG. 7 is a front perspective view of the drum component illustrated in FIG. 6.
Figure 10:
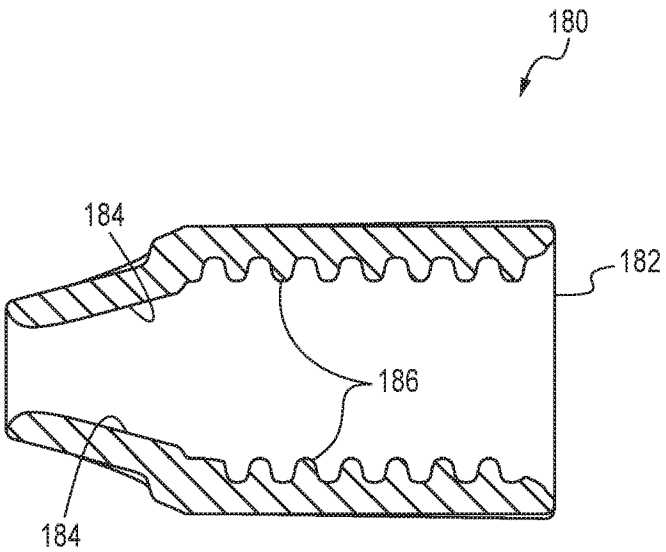
FIG. 10 is a cross sectional view of the nut taken across line 10-10 shown in FIG. 9.
Figure 9:
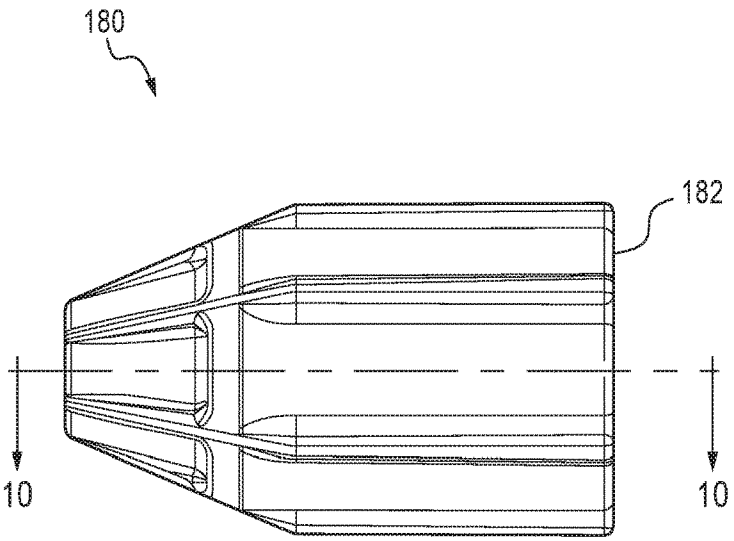
FIG. 9 is a side elevational view of the nut depicted in FIG. 8.
Figure 11:
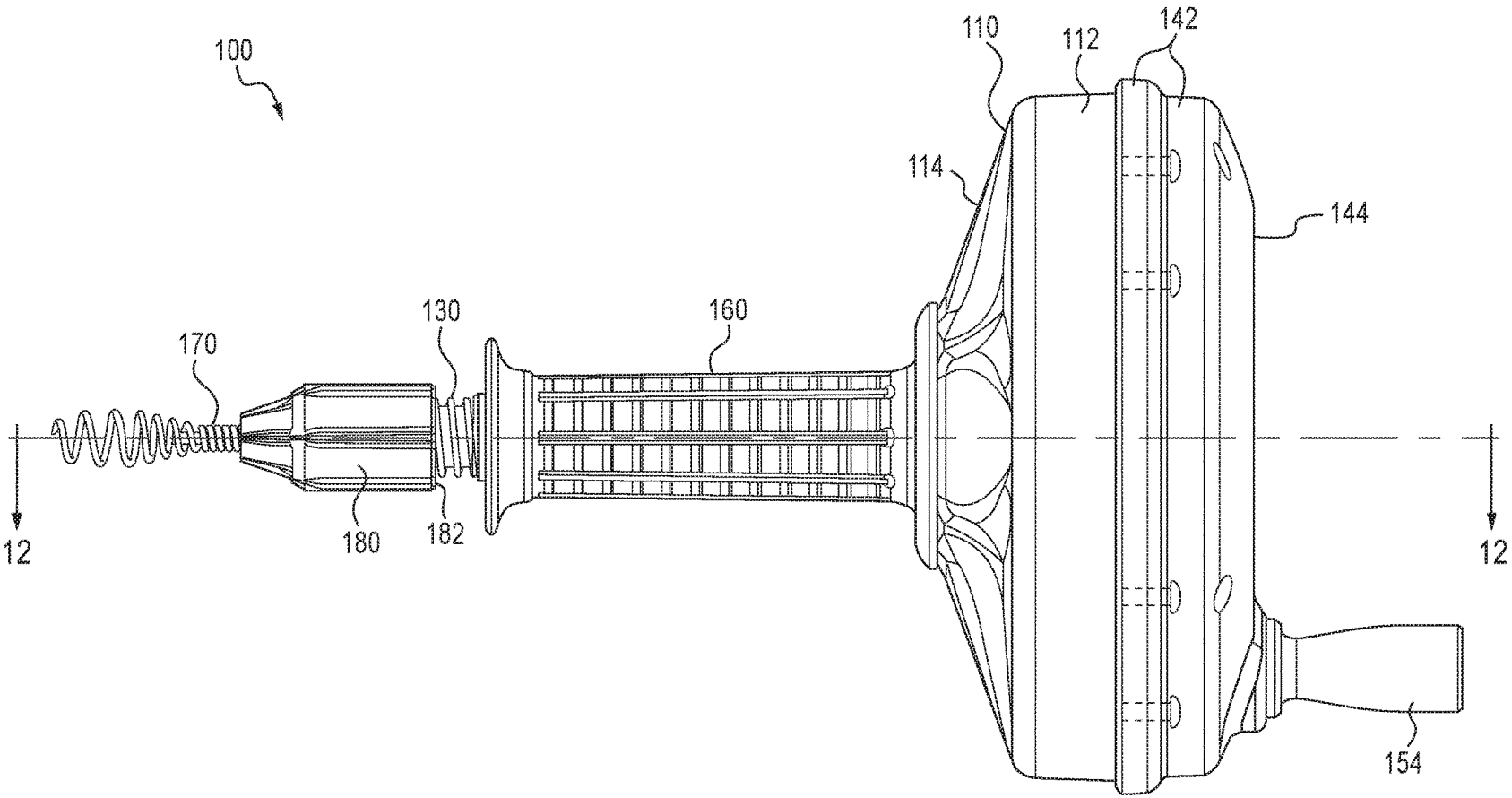
FIG. 11 is a side elevational view of the drain cleaning tool shown in FIGS. 3-4.
Figure 12:
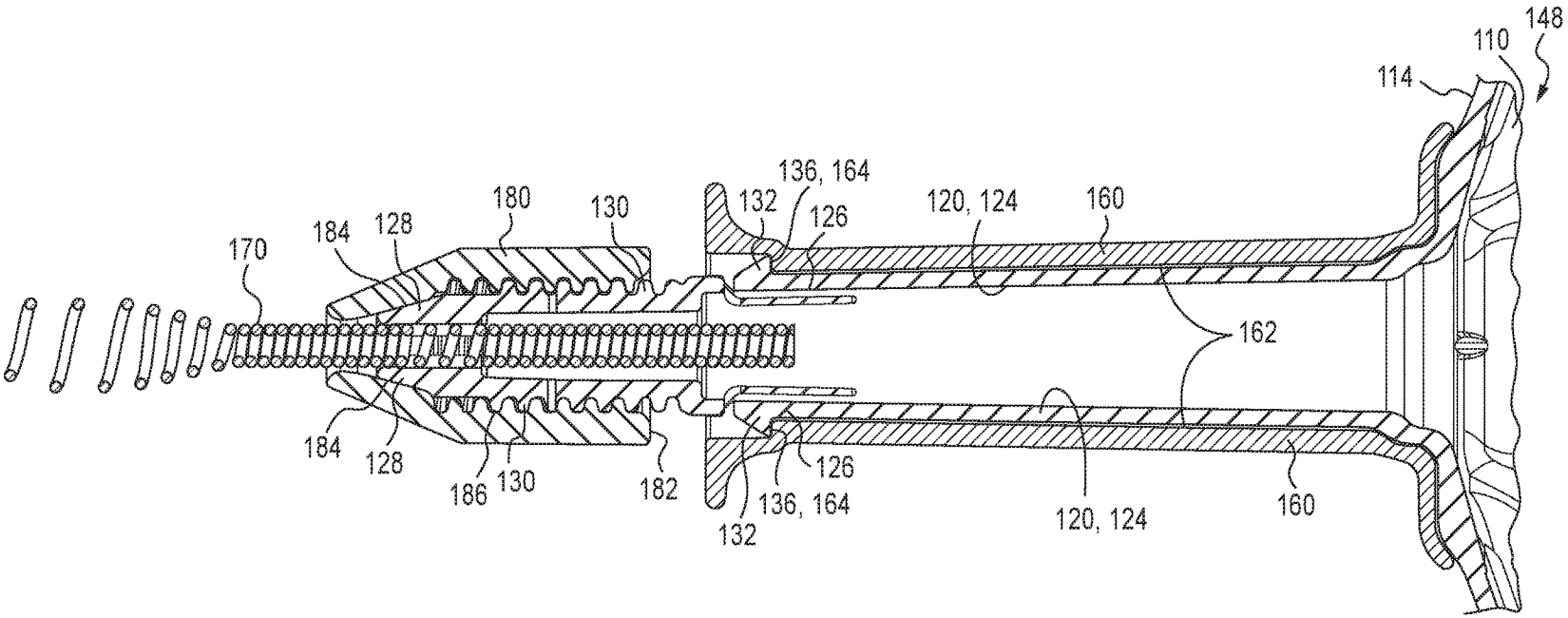
FIG. 12 is a detail portion of a cross sectional view of the tool taken across line II-II in FIG. 11.

The tool 100 also comprises a handle 160 having an axially extending interior passageway 162 sized to receive the cable guide 120. The handle 160 is disposed about the elongated cable guide 120 and is rotatable with respect to the drum 110, 140 and the cable guide 120. The handle 160 defines an annular race 164 within the interior passageway 162 and the at least one flexible retaining member 126 contacts the race 164, thereby rotatably retaining the handle 160 about the cable guide 120 of the drum axis. It will be appreciated that a variety of handle shapes and configurations can be used in the present subject matter drain cleaning tools. For example, a handle having a pistol grip member can be used for the handle 160, in which the pistol grip handle includes the aspects of handle 160 in addition to an outwardly extending pistol grip member. An optional pistol grip 161 is shown in FIG. 5. A nonlimiting example of a pistol grip member is shown in U.S. Pat. No. 6,158,076 as item 40.

In certain embodiments, the retaining member 126 is formed within an arcuate wall 124 of the elongated cable guide 120 and includes a radially extending, outwardly projecting finger 132 defining an inclined forwardly directed face 134 and a rearwardly directed bearing face 136 that contacts the annular race 164 of the handle 160.

In particular embodiments, the cable guide 120 includes two flexible retaining members 126, each member 126 formed within the arcuate wall 124 of the elongated cable guide 120 and disposed 180° apart from each other. However, it will be understood that the present subject matter includes the use of a fewer number or greater number of retaining member(s) 126. For versions utilizing two or more retaining members 126, the members are typically located equidistant from one another and are disposed about the outer periphery or circumference of the cable guide 120.

In particular embodiments of the tool 100, the distal end 122 of the elongated cable guide 120 includes (i) a plurality of axially extending flexible tabs 128 integrally formed with the elongated cable guide 120 and (ii) an outer threaded region 130.

The tool 100 also comprises a nut 180 defining (i) a rear face 182, (ii) a forwardly extending inner tapered face 184, and (iii) an inner threaded region 186 configured to threadedly engage the outer threaded region 130 of the cable guide 120. The nut 180 is threadedly engaged with the threaded region 130 of the cable guide 120. In certain versions, the nut 180 is free of metal. Typically, the nut 180 includes one or more polymeric material(s).

The tool 100 also comprises a knob 154 engaged along a rearward face 144 of the drum 100, 140.

The tool 100 additionally comprises a flexible drain cleaning cable 170 at least partially housed in the hollow chamber 148 of the drum 110, 140.

In a particular embodiment, the tool 100 consists essentially of a front drum 110 including a front face 114, a rearwardly extending cylindrical wall 112, and a forwardly projecting hollow elongated cable guide 120. The cable guide includes (i) a distal end 122 opposite the cylindrical wall 112, (ii) an arcuate wall 124 extending between the distal end 122 and the front face 114 of the front drum 110, (iii) at least one flexible retaining member 126 formed within the arcuate wall 124 of the cable guide 120, (iv) a plurality of axially extending flexible tabs 128 integrally formed with the cable guide 120 and disposed at the distal end 122, and (v) an outer threaded region 130 disposed between the plurality of axially extending flexible tabs 128 and the at least one flexible retaining member 126.

The tool 100 also consists essentially of a rear drum 140 including a rear face 144 and a cylindrical wall 142. The rear drum 140 is engaged with a rearward face of the cylindrical wall 112 of the front drum 110, thereby forming a chamber 148 for housing a drain cleaning cable.

The tool 100 also consists essentially of a plurality of fasteners 150 for securing engagement of the rear drum 140 with the front drum 110. It will be understood that a variety of provisions can be used instead of, or in combination with, the fastener(s) 150 for securing engagement of the rear drum 140 with the front drum 110. For example, one or more flexible snaps could be provided on either or both drum portions which engage receiving portions on the other drum portion to secure the portions together. Similar fastening provisions can be used to retain the handle or knob with the drum or drum portions.

The tool 100 also consists essentially of a knob 154 engaged along the rear face 144 of the rear drum 140.

The tool 100 also consists essentially of a handle 160 having an axially extending interior passageway 162 defining an annular race 164 and rotatably disposed about the elongated cable guide 120 of the front drum 110. The handle 160 is disposed between the threaded region 130 of the elongated cable guide 120 and the front wall 114 of the front drum 110. The at least one flexible retaining member 126 contacts the race 164 and thereby rotatably retains the handle 160 disposed about the cable guide 120. As previously noted, other handle shapes and configurations can be used for the handle 160 including for example a pistol grip handle.

The tool 100 also consists essentially of a flexible drain cleaning cable 170 at least partially housed in the chamber 148 formed from the front drum 110 and the rear drum 140.

The tool 100 also consists essentially of a nut 180 defining (i) a rear face 182, (ii) a forwardly extending inner tapered face 184, and (iii) an inner threaded region 186 configured to threadedly engage the outer threaded region 130 of the cable guide 120. The nut 180 is threadedly engaged with the threaded region 130 of the cable guide 120. Typically, and during use of the tool 100, at least a portion of the drain cleaning cable 170 extends through the elongated cable guide 120 and the nut 180, and upon rotation of the nut 180 relative to the cable guide 120, the nut 180 is linearly displaced against the plurality of axially extending tabs 128 of the cable guide 120 thereby resulting in deflection of the tabs 128 against the drain cleaning cable 170 to thereby secure the cable 170 at a desired axial position relative to the cable guide 120.

In certain embodiments, upon linear displacement of the nut 180 against the plurality of axially extending tabs 128, the inner tapered face 184 of the nut 180 contacts the plurality of axially extending flexible tabs 128 of the cable guide 120.

An array of drain cleaning cables or snakes as known in the art, can potentially be used in association with the present subject matter. For example, drain cleaning cables as described in any of the following patent documents assigned to the present Assignee could be used: U.S. Pat. Nos. 9,080,599; 6,615,436; 4,218,802; 6,412,136; 6,009,588; 6,243,905; 7,367,077; and 8,413,347.

The present subject matter includes drain cleaning tools like those described herein, but without the handle 160. In these versions of the tool, an operator would lightly grasp the outer surface of the cable guide member 120 and allow that member to rotate in the operator's hand while dispensing cable or retracting cable.

The present subject matter also includes drain cleaning tools like those described herein, but without a rotatable knob 154. Instead, a projection, an outwardly extending member, and/or a recess could be formed into or along the drum such as the rear drum 140 which an operator would grip during rotation of the drum. It will be understood that the present subject matter includes a range of alternate versions and varying embodiments. For example, the present subject matter includes drain cleaning tools without the previously noted handle 160 and without the previously noted knob 154. In such a version, an operator would lightly grasp the outer surface of the cable guide member and allow that member to rotate in the operator's hand while the operator also rotated the drum by engaging an integrally formed member associated with the drum, thereby causing cable to be dispensed or rotated.

Many of the components of the tool 100 are formed from polymeric materials which are durable and provide strength and rigidity as well as resistance to rusting. The components can be molded using known techniques such as injection molding.

Although the present subject matter drain cleaning tools have been described in terms of manually-driven tools, it will be appreciated that the present subject matter includes tools which utilize powered rotatable drums. Such tools could include or utilize a motor and drive provisions, for example, a belt between the drum and motor, to provide powered rotation of the drum.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A drain cleaning tool comprising:

a drum defining an interior hollow chamber for housing a drain cleaning cable, the drum defining a forward face and an oppositely directed rearward face, the drum including a forwardly projecting hollow elongated cable guide, the cable guide defining a distal end opposite the rearward face and including at least one flexible retaining member disposed between the distal end and the forward face of the drum;

a handle having an axially extending interior passageway sized to receive the cable guide, the handle disposed about the elongated cable guide and rotatable with respect to the drum, the handle defining an annular race within the interior passageway and the at least one flexible retaining member contacting the race, thereby rotatably retaining the handle about the cable guide of the drum;

wherein the retaining member is formed within an arcuate wall of the elongated cable guide and includes a radially extending, outwardly projecting finger defining an inclined forwardly directed face and a rearwardly directed bearing face that contacts the annular race of the handle.

2. The tool of claim 1 wherein the cable guide includes two flexible retaining members, each member formed within an arcuate wall of the elongated cable guide and disposed 180° apart from each other.

3. The tool of claim 1 wherein the distal end of the elongated cable guide includes (i) a plurality of axially extending flexible tabs integrally formed with the elongated cable guide and (ii) an outer threaded region.

4. The tool of claim 3 further comprising:

a nut defining (i) a rear face, (ii) a forwardly extending inner tapered face, and (iii) an inner threaded region configured to threadedly engage the outer threaded region of the cable guide;

wherein the nut is threadedly engaged with the threaded region of the cable guide.

5. The tool of claim 4 wherein the nut is free of metal.

6. The tool of claim 4 wherein the nut includes a polymeric material.

7. The tool of claim 1 further comprising:

a knob engaged along a rearward face of the drum.

8. The tool of claim 1 further comprising:

a flexible drain cleaning cable at least partially housed in the hollow chamber of the drum.

9. The tool of claim 1 wherein the handle includes an outwardly extending pistol grip member.

10. A drain cleaning tool comprising:

a front drum defining a front face, a rearwardly extending cylindrical wall and a forwardly projecting hollow elongated cable guide, the cable guide defining a distal end opposite the cylindrical wall, the distal end of the elongated cable guide including (i) a plurality of axially extending flexible tabs integrally formed with the elongated cable guide and (ii) an outer threaded region;

a rear drum sized and shaped to engage a rearward face of the cylindrical wall of the front drum, and thereby form a chamber for housing a drain cleaning cable;

a nut defining (i) a rear face, (ii) a forwardly extending inner tapered face, and (iii) an inner threaded region configured to threadedly engage the outer threaded region of the cable guidell;

wherein the cable guide includes at least one flexible retaining member disposed between the distal end of the cable guide and the front face of the front drum;

the tool further comprising:

a handle having an axially extending interior passageway and disposed about the elongated cable guide of the front drum and rotatable with respect to the front drum, wherein the handle defines an annular race within the interior passageway and the at least one flexible retaining member contacts the race and thereby rotatably retains the handle disposed about the cable guide;

wherein the at least one retaining member is formed within an arcuate wall of the elongated cable guide and includes a radially extending, outwardly projecting finger defining an inclined forwardly directed face and a rearwardly directed bearing face that contacts the annular race of the handle.

11. The tool of claim 10 wherein the cable guide includes two flexible retaining members.

12. The tool of claim 10 wherein the nut is free of metal.

13. The tool of claim 10 wherein the nut includes a polymeric material.

14. The tool of claim 10 further comprising:

a flexible drain cleaning cable at least partially housed in the chamber formed upon engagement of the front drum with the rear drum.

15. The tool of claim 10 further comprising:

a knob engaged with the rear drum.

16. The tool of claim 10 wherein the handle includes an outwardly extending pistol grip member.

17. A drain cleaning tool consisting essentially of:

a front drum including a front face, a rearwardly extending cylindrical wall, and a forwardly projecting hollow elongated cable guide, the cable guide including (i) a distal end opposite the cylindrical wall, (ii) an arcuate wall extending between the distal end and the front face of the front drum, (iii) at least one flexible retaining member formed within the arcuate wall of the cable guide, (iv) a plurality of axially extending flexible tabs integrally formed with the cable guide and disposed at the distal end, and (v) an outer threaded region disposed between the plurality of axially extending flexible tabs and the at least one flexible retaining member;

a rear drum including a rear face and a cylindrical wall, the rear drum engaged with a rearward face of the cylindrical wall of the front drum, thereby forming a chamber for housing a drain cleaning cable;

fastening provisions for securing engagement of the rear drum with the front drum;

a knob engaged along the rear face of the rear drum;

a handle having an axially extending interior passageway defining an annular race and rotatably disposed about the elongated cable guide of the front drum, the handle disposed between the threaded region of the elongated cable guide and the front face of the front drum, the at least one flexible retaining member contacting the race and thereby rotatably retaining the handle disposed about the cable guide;

a flexible drain cleaning cable at least partially housed in the chamber formed from the front drum and the rear drum;

a nut defining (i) a rear face, (ii) a forwardly extending inner tapered face; and (iii) an inner threaded region configured to threadedly engage the outer threaded region of the cable guide, the nut threadedly engaged with the threaded region of the cable guide;

wherein at least a portion of the drain cleaning cable extends through the elongated cable guide and the nut, and upon rotation of the nut relative to the cable guide, the nut is linearly displaced against the plurality of axially extending tabs of the cable guide thereby resulting in deflection of the tabs against the drain cleaning cable to thereby secure the cable at a desired axial position relative to the cable guide;

wherein the at least one flexible retaining member includes a radially extending, outwardly projecting finger that defines an inclined forwardly directed face and a rearwardly directed bearing face that contacts the annular race of the handle.

18. The tool of claim 17 wherein upon linear displacement of the nut against the plurality of axially extending tabs, the inner tapered face of the nut contacts the plurality of axially extending flexible tabs of the cable guide.

19. The tool of claim 17 wherein the nut is free of metal.

20. The tool of claim 17 wherein the nut includes a polymeric material.

* * * * *